United States Patent [19]

Miura et al.

[11] 4,044,739

[45] Aug. 30, 1977

[54] EXHAUST GAS CONTROL VALVE

[75] Inventors: Motohisa Miura, Kariya; Yukihiko Muramatsu, Hekinan; Noboru Matsumoto, Toyota, all of Japan

[73] Assignees: Nippondenso Co., Ltd., Kariya; Toyota Jidosha Kogyo Kabushiki Kaisha, Tokyta, both of Japan

[21] Appl. No.: 602,313

[22] Filed: Aug. 6, 1975

[30] Foreign Application Priority Data

Aug. 8, 1974 Japan ..... 49-95351[U]

[51] Int. Cl.[2] ..... F02M 25/00

[52] U.S. Cl. ..... 123/119 A

[58] Field of Search ..... 123/119 A

[56] References Cited

U.S. PATENT DOCUMENTS

| | | | |
|---|---|---|---|
| 3,800,765 | 4/1974 | Thompson | 123/119 A |
| 3,878,823 | 4/1975 | Vartanian | 123/119 A |
| 3,888,222 | 6/1975 | Tomita | 123/119 A |

FOREIGN PATENT DOCUMENTS

| | | | |
|---|---|---|---|
| 2,166,337 | 9/1973 | Germany | 123/119 A |

*Primary Examiner*—Wendell E. Burns

*Attorney, Agent, or Firm*—Cushman, Darby & Cushman

[57] ABSTRACT

An exhaust gas control valve comprising a diaphragm interposed between an outer upper casing and an outer lower casing of the diaphragm housing, the diaphragm and the upper outer casing defining a first pressure chamber, an inner upper casing attached to the upper surface of the diaphragm within the first pressure chamber, an inner lower casing attached to the undersurface of the diaphragm within the outer lower casing, the inner lower casing and the diaphragm defining a second pressure chamber, a valve housing attached to the bottom of the diaphragm housing and provided with an exhaust gas intake port, an exhaust gas discharge port and a valve seat member disposed in a passage between the exhaust gas intake and discharge ports, a valve head with a stem whose upper end is attached to the center of the diaphragm so that the valve head may be moved toward and away from the valve seat member depending upon the deflection of the diaphragm, the space or chamber defined by the diaphragm and the inner upper casing and the space or chamber defined by the diaphragm and the outer lower casing being communicated with the surrounding atmosphere, and the different negative pressures being transmitted to the first and second pressure chambers, respectively, whereby the quantity of exhaust gases to be recirculated may be controlled depending upon the operating conditions of the engine to minimize the nitrogen oxide (NOx) emission.

8 Claims, 3 Drawing Figures

EXHAUST GAS CONTROL VALVE

BACKGROUND OF THE INVENTION

1. Field of the Invention

The present invention relates to an exhaust gas control valve for controlling the quantity of exhaust gases to be recirculated in order to minimize the noxious (or toxic) emission, especially the nitrogen oxides (NOx) emission from an internal combustion engine.

2. Description of the Prior Art

There has been known an exhaust gas control valve which is operated by a diaphragm which in turn is deflected in response to the negative pressure transmitted through a port opening slightly upstream of throttle valve in a carburetor so that the flow rate of exhaust gases to be recirculated may be controlled in response to the operating conditions of an internal combustion engine. However, in the exhaust gas control valve of the described, the flow rate of exhaust gases to be recirculated is controlled only in response to the opening degree of the throttle valve so that the quantity of exhaust gases to be recirculated is less when the engine is running under the heavy load, resulting in emission of a large quantity of nitrogen oxides (NOx). As a result, the NOx emission cannot be reduced to a satisfactory degree. On the contrary, if the exhaust gas control valve of the type described is so arranged as to recirculate a large quantity of exhaust gases under the heavy load, the sufficient engine output cannot be obtained at low speeds so that the engine operation and the driver's feeling of the engine operation may be badly affected.

In order to overcome the above problems, there has been devised and demonstrated an exhaust gas control valve of the type having two diaphragms which are subjected to two different negative pressures (for instance, the negative pressure in the carburetor and the negative pressure of the intake air). However, the use of two diaphragms not only results in the inevitable increase in cost but also places the limits on the size (especially in the longitudinal direction) of the exhaust gas control valves which must be as compact as practicable as they are mounted on the automotive vehicles.

SUMMARY OF THE INVENTION

It is therefore an object of the present invention to provide an exhaust gas control valve which enables the effective reduction of the NOx emission.

It is another object of the present invention to provide an exhaust gas control valve which does not make any influence on the engine operation and the driver's feeling.

It is a further object of the present invention to provide an exhaust gas control valve which is simple in construction, compact in size and inexpensive to manufacture.

The other objects and advantages of the present invention will become apparent from the following description when read in connection with the drawings.

DESCRIPTION OF THE PREFERRED EMBODIMENTS

Figure 1:
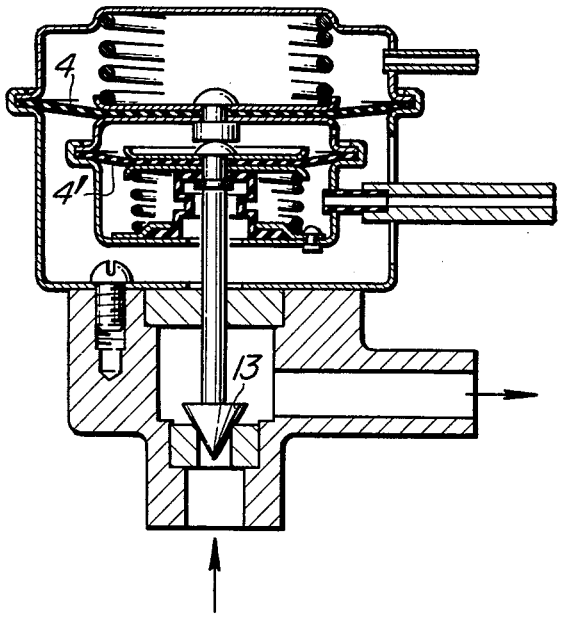
FIG. 1 PRIOR ART
FIG. 1 is a schematic sectional view of a prior art exhaust gas control valve.

Prior Art, FIG. 1

One typical prior art exhaust gas control valve is shown in FIG. 1 in order to point out distinctly and specifically the defects thereof. The prior art exhaust gas control valve has two diaphragms 4 and 4' whose deflection in response to the difference between the negative pressure in a carburetor and the negative pressure of intake air, controls the displacement of a valve head 13. The use of the two diaphragms 4 and 4' not only results in the increase in cost but also places the limits on the size (especially in the longitudinal direction) of the exhaust gas control valve which must be made as compact as practicable because it is mounted on the automotive vehicle.

Figure 2:
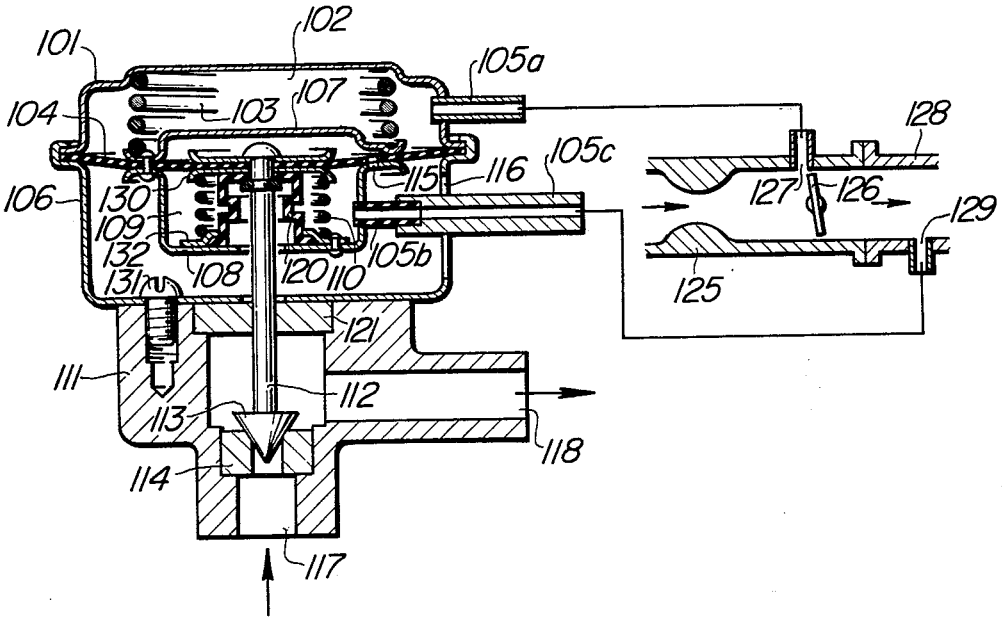
FIG. 2 is a schematic sectional view of an exhaust gas control valve in accordance with the present invention.
Figure 3:
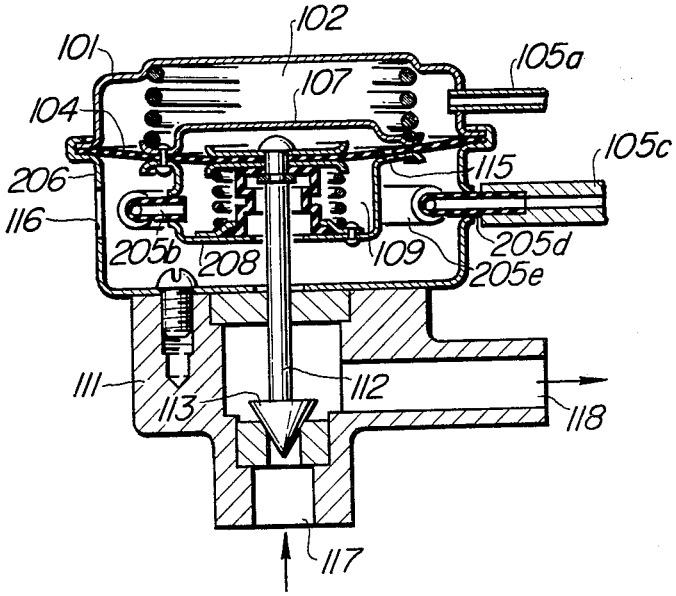
FIG. 3 is a schematic sectional view of a modification thereof.

The Invention, FIGS. 2 and 3

First referring to FIG. 2, an exhaust gas control valve in accordance with the present invention has a diaphragm housing consisting of an outer upper and lower casings 101 and 106 with a diaphragm 104 interposed therebetween. The compartment defined by the diaphragm 104 and the outer casing 101 forms a first (negative) pressure chamber 102. Within the first pressure chamber 102, an inner upper casing 107 is attached to the upper surface of the diaphragm 104, and a compression coiled spring 103 is disposed between the outer and inner upper casings 101 and 107. Within the outer lower casing 106, an inner lower casing 108 is attached to the undersurface of the diaphragm 104 to form a second (negative) pressure chamber 109, and a compression spring 110 is disposed between the spring retainers 130 and 132 attached to the diaphragm 104 and the inner lower casing 108, respectively. A bellows 120 surrounding a valve stem 112 is interposed between the spring retainer 130 and the bottom of the inner lower casing 108 so as to secure the air-tightness of the second pressure chamber 109. The bellows 120 is secured to the bottom of the inner lower casing 108 by the spring retainer 132.

The compartment defined by the upper inner casing 107 and the upper surface of the diaphragm 104 is communicated with the surrounding atmosphere through a hole 115 formed through the diaphragm 104 and the flange of the lower inner casing 108 and a hole 116 formed through the side wall of the outer lower casing 106. The compartment defined by the diaphragm 104, the outer lower casing 106 and the inner lower casing 108 is therefore also communicated with the surrounding atmosphere through the hole 116. The first pressure chamber 102 is communicated through a (negative) pressure transmission line **105*a* with a port 127 opening into a carburetor 125 slightly upstream of a throttle valve 126. The second pressure chamber 109 is communicated through a flexible pressure tube 105*b* and a pressure transmission line 105*c* extending through the side wall of the outer lower casing 106 with a port 129 opening into an air intake pipe 128 so that the negative pressure of intake air may be transmitted to the second pressure chamber 109. Here, it should be, of course, noted that the flexible pressure tube 105*b* may be replaced by a metal tube with a flexible tube used for pressure transmission line 105*c*.**

The outer lower casing 106 is attached to a valve housing 111 by means of screws 131.

The valve housing 111 includes an exhaust gas intake port 117 to be connected with an exhaust manifold of an engine and an exhaust gas discharge port 118 may be connected with an intake manifold of the engine.

A valve head 113 with the valve stem 112 whose upper end is attached to the center of the diaphragm 104 is so arranged as to move toward and away from a valve seat member 114 disposed in the passage between the exhaust gas intake and discharge ports 117 and 118. The valve housing 111 has a bush 121 which serves as a guide for the valve stem 112.

Next the mode of operation of the exhaust gas control valve with the above construction will be described. The negative pressure in the carburetor 125 at the upstream of the throttle valve 126 is transmitted to the first pressure chamber 102 through the port 127 and the pressure line 105*a,* and causes the upward displacement of the upper and lower inner casings 107 and 108. In like manner, the negative pressure in the air pipe 128 is transmitted through the port 129, the pressure line 105*c* and the flexible pressure tube 105*b* to the second pressure chamber 109 and causes the downward displacement of the inner portion of the diaphragm 104 surrounded by the upper and lower inner casings 107 and 108. The displacement of the diaphragm 104 is transmitted to the valve stem 112 and hence to the valve head 113, and is therefore the sum of the displacement of the upper and lower inner casings 107 and 108 and the deflection of the diaphragm 104 within the upper and lower inner casings 107 and 108. Accordingly, the opening degree of the exhaust gas control valve; that is, the opening area of the exhaust gas recirculation passage defined by the valve head 113 between the exhaust gas intake and discharge ports 117 and 118, is dependent upon the difference in negative pressure between the ports 127 and 129. When the engine load is so large as to increase the nitrogen oxide (NOx) emission, the opening degree of the exhaust gas control valve is increased so that a large amount of the exhaust gases may be recirculated therethrough. Thus, the nitrogen oxide emission may be minimized.

Modification, FIG. 3

FIG. 3 shows a modification of the arrangement shown in FIG. 2, and same reference numerals are used to designate similar parts throughout FIGS. 2 and 3. The modification shown in FIG. 3 is substantially similar in construction to the preferred embodiment shown in FIG. 2 except that a flexible pressure tube 205*b* attached to a lower inner casing 208 is interconnected with flexible pressure pipe 205*d* extended through the side wall of the outer lower casing 206 by means of a flexible communication tube 205*e.* In the like manner as explained in connection with FIG. 2, it should be also noted that a flexible tube may be used for pressure transmission line 105*c* and the flexible pressure tubes 205*b* and 205*d* may be replaced by metal tubes, respectively. This modification has the distinct advantage in that the accurate operation of the exhaust gas control valve may be ensured because the valve stem 112 is just dependent upon the negative pressure difference described above but is satisfactorily isolated from the external forces such as the vibration of the engine or chassis of the automotive vehicle.

So far the negative pressure slightly upstream of the throttle valve 126 in the carburetor 125 has been described as being transmitted through the port 127 to the first pressure chamber 102, but it will be understood that the negative pressure such as the venturi negative pressure representative of the intake air quantity may be transmitted to the first pressure chamber 102. That is, the negative pressures to be introduced into the diaphragm housing may be so selected that the effective reduction in NOx emission may be attained without causing the adverse effects upon the engine operations and the driver's feeling of the engine operation.

What we claim is:

1. An exhaust gas control valve for an internal combustion engine comprising;

an upper and a lower outer casings;

a diaphragm interposed between said upper and lower outer casings for forming respectively upper and a lower compartments, said lower compartment being communicated wth the atmosphere;

an upper inner casing disposed in said upper compartment and fixed to said diaphragm;

a first spring disposed in said upper compartment for biasing said diaphragm toward said lower compartment;

said upper outer casing, said upper inner casing and said diaphragm forming a first sealed negative pressure chamber to be interconnected with a carbureter for being applied with the negative pressure in said carbureter;

a lower inner casing disposed in said lower compartment and fixed to said diaphragm;

a bellows fixed to said diaphragm and said lower inner casing;

said bellows, said diaphragm and said lower inner casing forming a second sealed negative pressure chamber to be interconnected with an intake manifold of an engine for being applied with the negative pressure in said intake manifold;

a second spring disposed in said second sealed negative pressure chamber for biasing said diaphragm toward said upper compartment;

a valve seat disposed in a conduit communicating an exhaust pipe of said engine with an intake pipe of said engine;

a rod fixed at one end thereof to the inner portion of said diaphragm surrounded by said lower inner casing, said rod being provided at the other end thereof with a valve head for abutting on said valve seat, whereby the amount of the exhaust gases flowing through said conduit is controlled by the displacement of said rod driven by said diaphragm.

2. An exhaust gas control valve as set forth in claim 1, wherein said second sealed negative pressure chamber is interconnected with said intake manifold by means of a pipe means, said pipe means comprising;

a metal tube coupled at one end thereof to said intake manifold and opening thereto; and a flexible tube connected at its one end to the other end of said metal tube, the other end thereof being connected with said lower inner casing and opening to said second sealed negative pressure chamber.

3. An exhaust gas control valve as set forth in claim 1, wherein said second sealed negative pressure chamber is interconnected with said intake manifold by means of a pipe means, said pipe means comprising;

a metal tube coupled at one end thereof to an opening to said intake manifold;

a first flexible tube fixed to said lower outer casing and being interconnected at one end thereof with the other end of said metal tube;

a second flexible tube disposed in said lower compartment and interconnected at one end thereof with the other end of said first flexible tube; and a third flexible tube interconnected at one end thereof with the other end of said second flexible tube, the other end thereof being coupled to said lower inner casing and opening to said second sealed negative pressure chamber.

4. An exhaust gas control valve for an internal combustion engine comprising;

an upper and a lower outer casings;

a diaphragm interposed between said upper and lower outer casings for forming respectively upper and a lower compartments, said lower compartment being communicated with the atmosphere;

an upper inner casing disposed in said upper compartment and fixed to said diaphragm;

said upper outer casing, said upper inner casing and said diaphragm forming a first sealed negative pressure chamber to be interconnected with a first power source of the negative pressure representing one of the engine operational conditions;

a first spring disposed in said first sealed negative pressure chamber for biasing said diaphragm toward said lower compartment;

a lower inner casing disposed in said lower compartment and fixed to said diaphragm;

a bellows fixed to said diaphragm and said lower inner casing for forming a second sealed negative pressure chamber in communication with said lower inner casing and said diaphragm, said second sealed negative pressure chamber being interconnected with a second power source of the negative pressure representing another of the engine operational conditions;

a second spring disposed in said second sealed negative pressure chamber for biasing said diaphragm toward said upper compartment;

a valve seat disposed in a conduit communicating an exhaust pipe of an engine with an intake pipe of said engine;

a rod fixed at one end thereof to the inner portion of said diaphragm surrounded by said lower inner casing, said rod being provided at the other end thereof with a valve head for abutting on said valve seat, whereby the amount of exhaust gases flowing through said conduit is controlled by the displacement of said rod driven by said diaphragm.

5. An exhaust gas control valve for an internal combustion engine comprising;

an upper and a lower outer casings for respectively forming an upper and a lower compartments divided by a diaphragm interposed therebetween, said upper compartment forming a first sealed negative pressure chamber to be interconnected with a first power source of the negative pressure;

a second sealed negative pressure chamber disposed in said lower compartment and fixed to said diaphragm, said second sealed negative pressure chamber being interconnected with a second power source of the negative pressure by means of a pipe means;

a valve seat disposed in a conduit communicating an exhaust pipe of an engine with an intake pipe of said engine; and a rod fixed at its one end to a diaphragm forming said second sealed negative pressure chamber, said rod being provided at the other end thereof with a valve head for abutting on said valve seat, thereby to control the amount of exhaust gases flowing through said conduit, wherein said pipe means comprises;

a metal tube coupled to at its one end and opening to said second power source;

a first flexible tube fixed to said lower outer casing and being flexible at its one end with the other end of said metal tube;

a second flexible tube disposed in said lower compartment and interconnected at one end thereof with the other end of said flexible tube; and a third flexible tube interconnected at its one end with the other end of said second flexible tube, the other end thereof opening to said second sealed negative pressure chamber.

6. An exhaust gas control valve as set forth in claim 4, wherein said second sealed negative pressure chamber is interconnected with said coupling power source of the negative pressure by means of a pipe means, said pipe means comprising:

a flexible tube coupled at its one end to said second power source; and a metal tube connected at its one end to the other end of said flexible tube, the other end thereof being connected to said lower inner casing and opening to said second sealed negative pressure chamber.

7. An exhaust gas control valve as set forth in claim 4, wherein said second sealed negative pressure chamber is interconnected with said second power source of the negative pressure by means of a pipe means, said pipe means comprising:

a first flexible tube coupled at its one end to said second power source;

a first metal tube fixed to said lower outer casing and being interconnected at its one end with the other end of said first flexible tube;

a second flexible tube disposed in said lower compartment and interconnected at its one end with the other end of said first metal tube; and a second metal tube interconnected at its one end with the other end of said flexible tube, the other end thereof being coupled to said lower inner casing and opening to said second sealed negative pressure chamber.

8. An exhaust gas control valve for an internal combustion engine comprising:

an upper and a lower outer casings for respectively forming an upper and a lower compartments divided by a diaphragm interposed therebetween, said upper compartment forming a first sealed negative pressure chamber to be interconnected with a first power source of the negative pressure;

a second sealed negative pressure chamber disposed in said lower compartment and fixed to said diaphragm, said second sealed negative pressure chamber being interconnected with a second power source of the negative pressure by means of a pipe means;

a valve seat disposed in a conduit communicating an exhaust pipe of an engine with an intake pipe of said engine; and a rod fixed at its one end to a diaphragm forming said second sealed negative pressure chamber, said rod being provided at the other end thereof with a valve head for abutting on said valve seat, thereby to control the amount of exhaust gases flowing through said conduit, wherein said pipe means comprises:

a first flexible tube coupled at its one end to said second power source;

a first metal tube fixed to said lower outer casing and being interconnected at its one end with the other end of said first flexible tube;

a second flexible tube disposed in said lower compartment and interconnected at its one end with the other end of said first metal tube; and a second metal tube interconnected at its one end with the other end of said second flexible tube, the other end thereof being coupled to said lower inner casing and opening to said second sealed negative pressure chamber.

* * * * *